United States Patent [19]

George

[11] Patent Number: 5,022,134

[45] Date of Patent: Jun. 11, 1991

[54] METHOD OF REPAIRING/REPLACING A POLE AND ASSOCIATED POLE REPLACEMENT SYSTEM

[75] Inventor: Ross J. George, Victoria, Australia

[73] Assignee: Austpole Industries Limited, Australia

[21] Appl. No.: 569,739

[22] Filed: Aug. 21, 1990

Related U.S. Application Data

[63] Continuation of Ser. No. 449,071, Nov. 3, 1989, abandoned, which is a continuation of Ser. No. 147,599, Jan. 22, 1988, abandoned, which is a continuation of Ser. No. 915,386, Oct. 6, 1986, abandoned.

[51] Int. Cl.[5] ..... B23P 6/00

[52] U.S. Cl. ..... 29/402.08; 29/402.11; 29/402.12; 52/514; 52/721; 405/232

[58] Field of Search ..... 29/402.01, 402.08, 402.09, 29/402.11, 402.12; 405/244, 251, 303, 231, 232, 252; 361/245; 144/136 H; 52/514, 721

[56] References Cited

U.S. PATENT DOCUMENTS

| | | | |
|---|---|---|---|
| 2,133,563 | 10/1938 | Parks, Jr. et al. | 405/251 |
| 3,555,833 | 1/1971 | Correa | 405/232 |
| 3,911,548 | 10/1975 | Perry | 29/402.12 |
| 4,033,080 | 7/1977 | Fukushima | 29/402.12 |
| 4,048,779 | 9/1977 | Valenziano et al. | 29/402.12 |
| 4,371,018 | 2/1983 | Arnold . | |
| 4,492,496 | 1/1985 | Arnold . | |
| 4,525,102 | 6/1985 | Gillen | 405/232 |

FOREIGN PATENT DOCUMENTS

| | | | |
|---|---|---|---|
| 524678 | 1/1982 | Australia . | |
| 41440 | 9/1937 | Netherlands | 405/251 |

OTHER PUBLICATIONS

Mod/Pole TM, Concrete Modular Replacement Poles, Interpace Corporation.

*Primary Examiner*—P. W. Echols
*Assistant Examiner*—D. Cuda
*Attorney, Agent, or Firm*—Roylance, Abrams, Berdo & Goodman

[57] ABSTRACT

A pole replacement system employs a pole replacement section. The section includes a sleeve partially filled with a substantially non-compressible material. The material defines a cavity with the sleeve for receiving an end of a pole. The non-compressible material is only located in the sleeve and does not extend axially beyond the sleeve.

13 Claims, 9 Drawing Sheets

METHOD OF REPAIRING/REPLACING A POLE AND ASSOCIATED POLE REPLACEMENT SYSTEM

This is a continuation of application Ser. No. 07/449,071 filed Nov. 3, 1989, abandoned which is a continuation of application Ser. No. 07/147,599 filed Jan. 22, 1988, abandoned which is a continuation of application Ser. No. 915,386 filed Oct. 6, 1986 abandoned.

BACKGROUND OF THE INVENTION

This invention relates to poles such as wood poles and like supports, such as for electric power or telephone transmission lines, fence posts, pier and groyne piles, and stubs for building-frames, said supports being of a type prone to deterioration such as by termite, fungal and other infestation in the wood at or below ground level.

The consequences of such deterioration are likely to be serious. Weakened poles are prone to collapse, especially when exposed to high winds, and (especially if this should happen in a remote place) can as a result leave wide areas without electric power or telephone communications for long periods of time. Furthermore, hot molten metal particles in the form of electric sparks from fallen, damaged or crossed wires attached to such poles can cause serious fires.

In the past, wood poles or supports have been impregnated with fungicides, insecticides or other chemical repellents, or have been otherwise treated in an attempt to prevent, delay or halt the degradation of timber of the groundline. However it can be said, in general, that such attempts have not been completely satisfactory.

PRIOR ART

In Australian Patent No. 524678 (corresponding to U.S. Pat. No. 4,492,496) a method of restoring or extending a pole is described which entailed raising the pole vertically so that the lower end of the pole could receive a mechanism joining the pole to a stub. The pole and stub is thereafter re-established in the ground. The type of stub described is a support stub usually of concrete with a sliding sleeve which can be raised to envelope the upper portion of the stub and lower portion of the pole. A similar sleeve stub is disclosed in Australian application No. 22,674/35.

A further attempt to restore or extend power poles is disclosed in U.S. Pat. No. 3,911,548 Perry and more fully in The Mod Pole Systems—Specifications Class III-9 Module and Utility Methods—Electrical World—Jan. 5, 1980 pp. 82–83. Basically this system comprises the location of a tall concrete stub in the ground which protrudes a considerable distance above the ground. The existing pole is cut at the desired height and placed atop the stub. Affixing is carried out by the provision of a sleeve which is either initially placed overlapping the top of the stub defining a cavity into which the pole is received or by sliding the sleeve into overlapping relation with both stub and pole.

In both Australian Patent No. 524678 and U.S. Pat. No. 3,911,548 the concrete stub is located in the ground and the stability of the pole resides upon the compressive strength of the concrete used.

BRIEF STATEMENT OF THE INVENTION

An object of the invention is to provide an improved strong and firm base for a pole in substitution for a base which may have been weakened such as by rotting, termite or fungal attack.

Another object is to permit lengthen or shorten a pole by providing a substitute base of selected length.

A further object is to provide an improved pole of superior efficacy, reliability, stability and/or safety having regard to prior such poles as have been subjected or prone to attack by termites, fungi and/or water.

In a first embodiment of the invention there is provided a pole replacement section of substantially non-corrosive material comprising a sleeve partially filled with substantially non compressible material which defines with the sleeve a cavity adapted to receive an end of a pole. Typically the sleeve is fabricated of steel or aluminium though other materials having similar strength characteristics may be suitable.

It is possible by the use of such a sleeved section to enhance the compression strength of the material within it e.g. concrete and minimize degradation thereof under long term axial compressive stress influence of the pole. Further such material has low tensile strength and thus the sleeve enhances the life of stubs such as concrete by relieving some of tensile stresses on the stubs which are occassioned by the effect of wind etc. upon the pole.

Preferably the sleeve is provided with wedging means to assist firm location of the end of the pole in the cavity. Typically the wedging means comprise a plurality of wedges located in the cavity about the periphery of the sleeve. The wedge may be of any suitable material which will not unduly deform. Another alternate form of the wedging means is by provision of resiliently deformable members e.g. springsteel bars each having a portion radially displaced from the periphery of the sleeve towards the axis of the sleeve.

In a second embodiment of the invention a method is provided of restoring, strengthening, lengthening or shortening a load-bearing or normally load-bearing pole which comprising the steps of independently supporting the load, as necessary, to relieve the pole thereof, fitting to the pole a corrosion-resistant pole stub or insert member having a substantially rigid sleeve forming closed or closable interior cavity wholly or partially filled with substantially incompressible material such that when the load is again put on the pole the sleeve is rigidified by pressure of the material therein, the stub or insert thereby constituting, in effect, a portion of the pole.

In a third embodiment of the invention a method is provided of restoring, strengthening, lengthening or shortening a load-bearing or normally load-bearing pole which includes a damaged or damage-prone section, comprising the steps of independently supporting the load, as necessary, to relieve the pole thereof, severing and removing part of the pole including whole or part of said section, fitting to the remaining portion or portions a corrosion-resistant pole stub or insert member having a substantially rigid sleeve so as to form a closed or closable interior cavity and wholly or partially filling the cavity with substantially incompressible material such that when the load is again put on the pole the sleeve is rigidified by pressure of the material therein, the stub or insert thereby constituting, in effect, a portion of the pole.

In another preferred form of the invention a base element for a pole, or part thereof, consists of a concrete or like stub and associated therewith a metal or like tube adapted to receive the lower end of the pole in abutting relationship with the upper end of the stub. The stub may be of constant cross-section corresponding to the pole (or the lower end portion thereof) and to the internal cross-section of the tube. Generally this cross-section will be circular. If desired the lower ends of the tube and stub may be coplanar.

A suitable base element or "fixed sleeve stub" can be made by providing a suitable length (T) of pipe, standing the pipe upright, and pouring in concrete to the desired "stud" depth S. When the concrete has set to the desired extent, the pole is placed in position with its lower end in the sleeve. Before so doing, a damaged lower portion may be severed from the pole, S and T will generally depend upon the diameter of the pole, depth D of implantation of stub-tube base and the desired height J of stub/pole junction above the ground.

The pipe may be protected against corrosion in any suitable manner e.g. by galvanizing or painting or epoxy-coating.

BRIEF DESCRIPTION OF THE DRAWINGS

The invention will now be more fully illustrated with reference to the accompanying drawings in which the same numerals refer to like elements throughout and which are to be considered as part of this specification and read herewith. In the drawings.

Figure 1A:
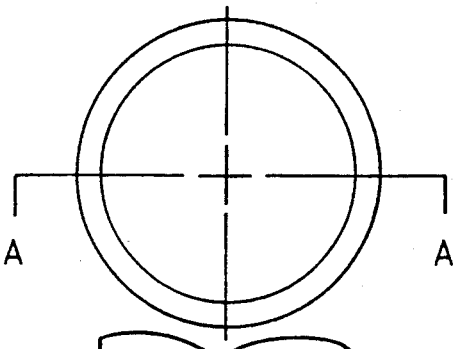
FIG. 1A is a plan view of the base portion of FIG. 1.
Figure 1:
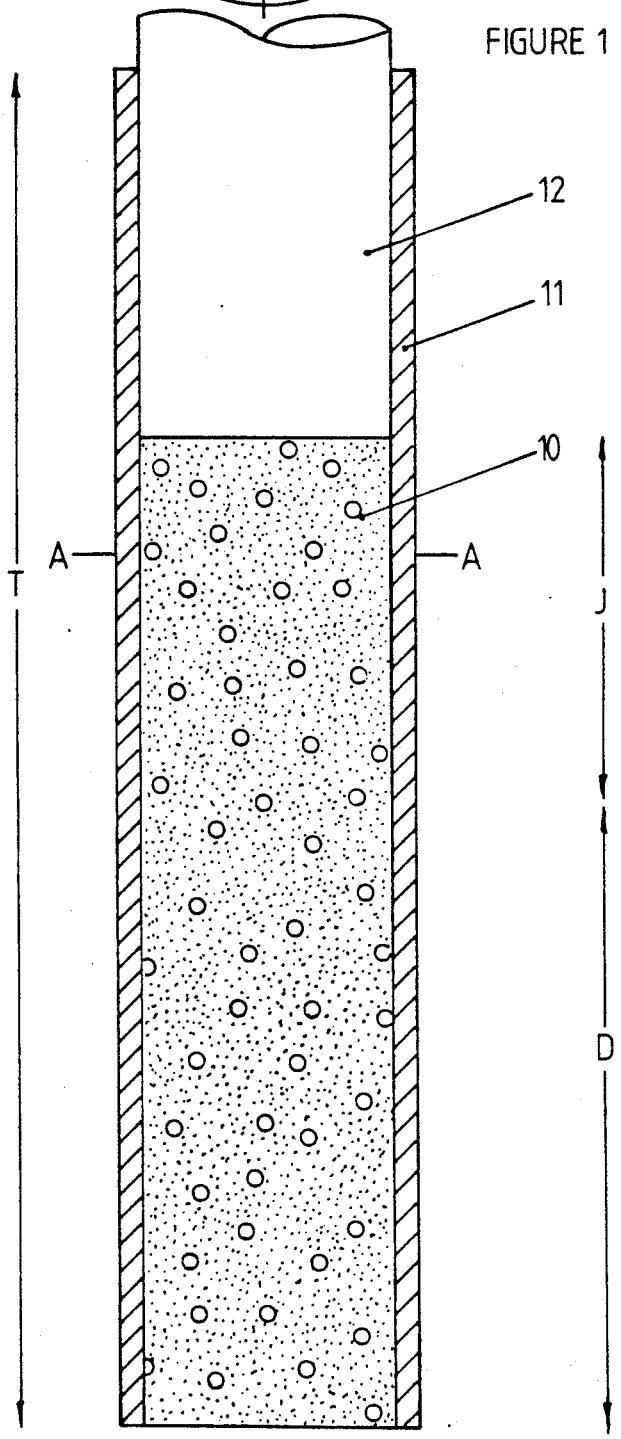
FIG. 1 is an axial section through the base portion of a pole restored by substituting a new base or stub according to one practical embodiment of the invention.

Referring more particularly to FIG. 1, a base element can be applied for strengthening and/or lengthening (or shortening) a pole such as by using the method and apparatus of Australian Patent No. 524678 aforementioned. With symbols D, J, S and T defined above, let H be the above-ground height of an original pole of total length $L=H+G$ buried to a depth G in the ground. Let B be a length to be sawn from the base of the pole (for example, because it is damaged by floods). Then the height of the pole after applying the base element and re-instating in the ground will be $L+J-B=H+G+S-D-B$.

Among the advantages of using such a base element are that no tight dimensional tolerances are usually required on any of the materials during manufacture; the base element is quick and simple to manufacture and can reduce "lead time" to as little as about ten days, compared with thirty days which can be required for some kinds of "sliding sleeve" arrangements; it is cheaper (with a generally reduced labour component); concrete can usually be poured by unskilled labour; in general, no reinforcement is required in the concrete, and the quality of the concrete is not usually critical.

Referring to FIG. 1 a stub part of concrete or like resistant material, is destined to be embedded in the ground and to act as a firm supporting base for a timber part the remote end of which has connections for wires or the like to be supported at a suitable height above the ground (not shown), and junction means in the form of a sleeve 11 adapted to join the two parts so that one constitutes in effect a substantially rigid continuation of the other.

The timber part may itself be treated along whole or part of its length with a suitable preservative and/or repellant the concentration of which may be increased inside the sleeve.

The junction means is a peripherally continuous or discontinuous steel/aluminium collar or sleeve with suitable connections to the respective stub and timber parts (not shown). Usually it is of length about five times the major transverse dimension of the timber part. Clearly the parts may differ in cross-sectional size and shape, but it will be seen that in general the dimensions (and in particular the length) of the stub will depend on the height and dimensions (and in particular the length) of the timber part.

Thus the stub is of constant circular or other cross-section to match that of the timber part, or the stub may have a cross-section differing in shape or size, or both, from that of the timber part. The cross-section may vary, if desired, as to shape or size or both. The stub may be of reinforced concrete or of steel or any other material of suitable durability strength and resistance having regard to factors such as prevailing or foreseeable types of erosion. The junction means may be integral with or otherwise part of the stub.

In use, a suitable hole is dug to receive the stub of the prefabricated pole and the pole is raised to the vertical with the stub buried to the desired depth. Usually the junction between stub 11 and timber parts is 0.2 to 0.35 meters above ground level but with a substantial length of the junction sleeve or collar below ground level.

Thus in operation to sleeve 11 is positioned in the ground so that it protrudes therefrom. Concrete 10 is poured into the sleeve 11 to substantially fill same and form a cavity for receiving the pole end 12. The concrete 10 is allowed to set and develop its full strength before insertion of pole end 12.

Figure 2:
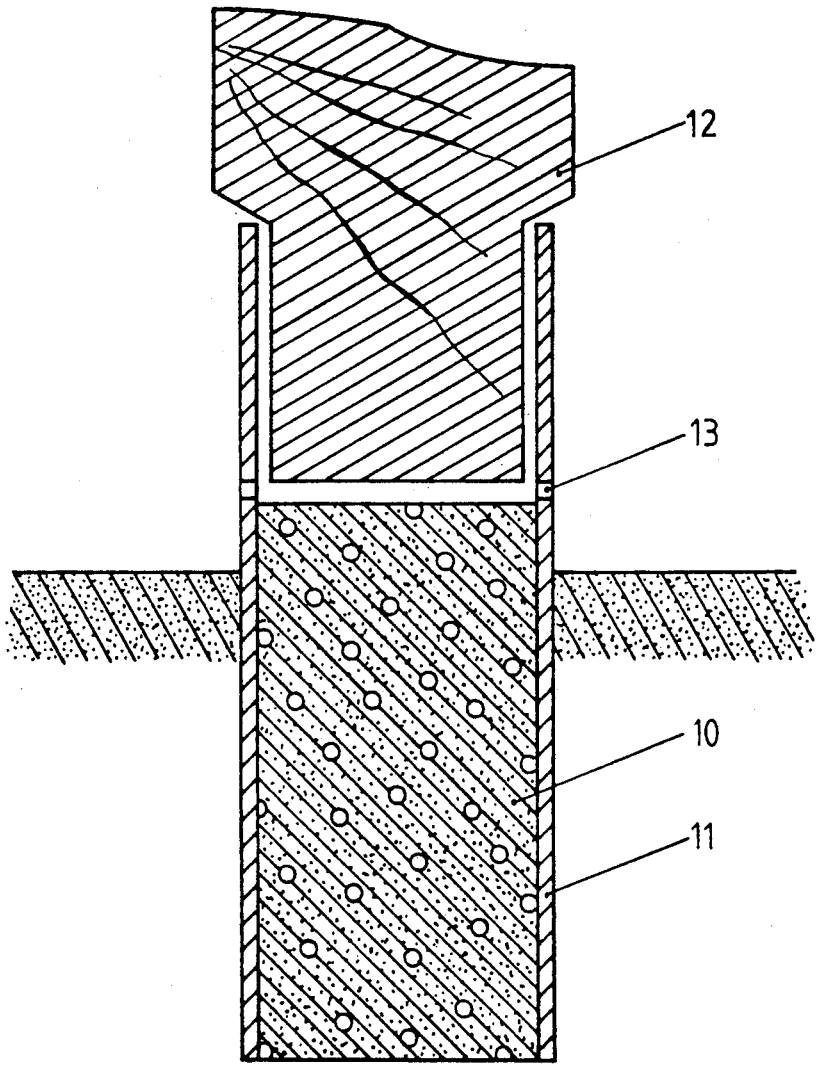
FIG. 2 is a cross-section of a second pole replacement section according to the invention.

In an alternate arrangement as shown in FIG. 2 sleeve 11 is filled with concrete 10 up to a level just under where drain holes 13 are provided. These holes 13 are incorporated above ground level and permit excess preservative or unwanted moisture to drain. Pole end 12 is shown just above drain holes 13 but in its final position abuts concrete 10.

Figure 3A:
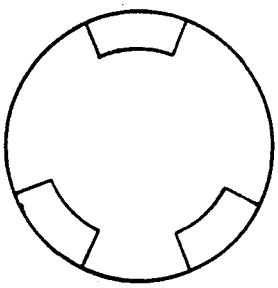
FIG. 3 and FIG. 3A are a cross-section and plan, respectively of a third pole replacement section according to the invention.
Figure 3:
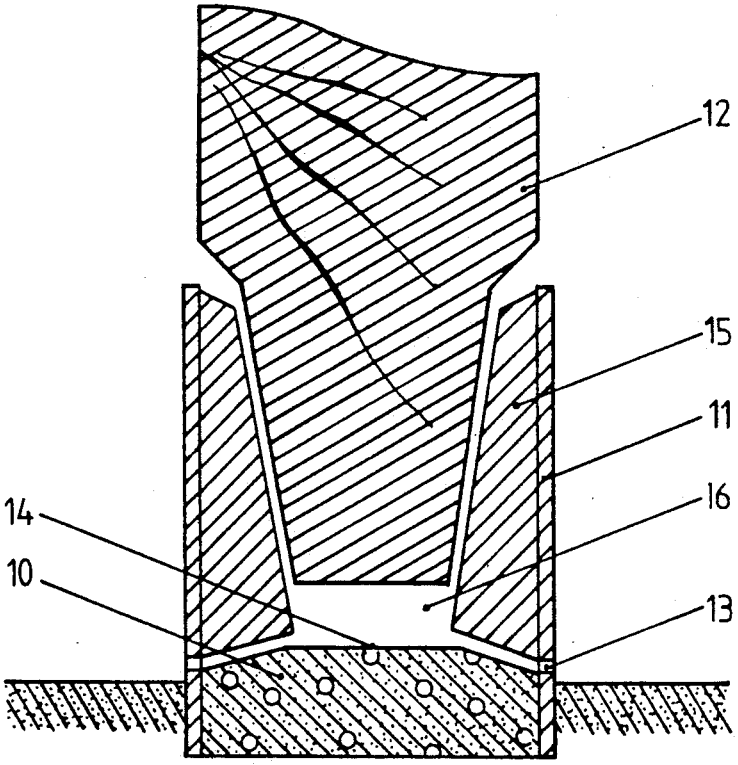

FIG. 3 depicts a modified form of the pole replacement sections of FIG. 2. Concrete 10 fills sleeve 11 to adjacent holes 13 but centrally comes upward to form a bearing surface 14. A plurality of wedges 15 are arranged peripherally about the inside of sleeve 11 to present a tapering cavity 16 to the pole end 12. This arrangement allows the secure positioning of irregular shaped pole ends 12 of the type shown. As these pole ends tend to shrink after loss of moisture it becomes further securely wedged in the pole replacement section.

Figure 4:
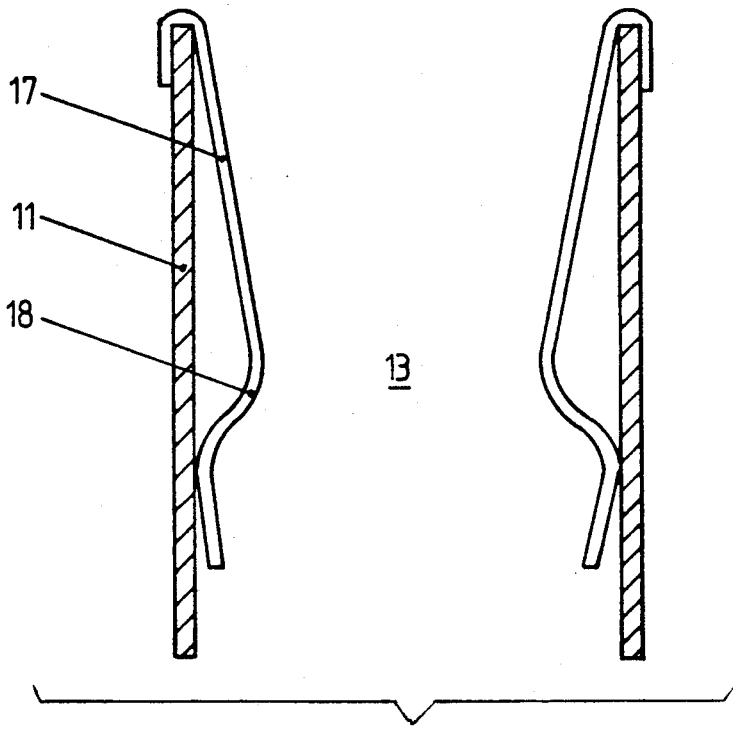
FIG. 4 is a partial cross-section of a fourth pole replacement section according to the invention.
Figure 5:
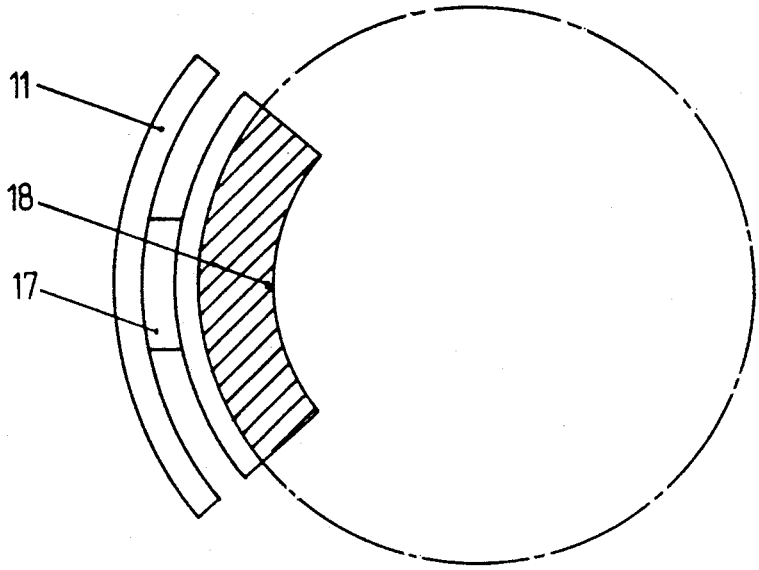
FIG. 5 is a partial plan view of the replacement section of FIG. 4.

FIGS. 4 & 5 depict an alternate form of securing device to ensure continuous secure attachment of the pole replacement section to the pole end notwithstanding that the pole end shrinks. A spring or resilient member 17 is attached in the cavity 13 to sleeve 11. Member 17 has a portion 18 protruding into the cavity 13 which engages the pole end (not shown) when inserted in the sleeve 11. Such insertion forces portion 18 to be resiliently displaced radially towards sleeve 11. As the pole end shrinks portion 18 resiles thus maintaining secure placement of the end.

Figure 6:
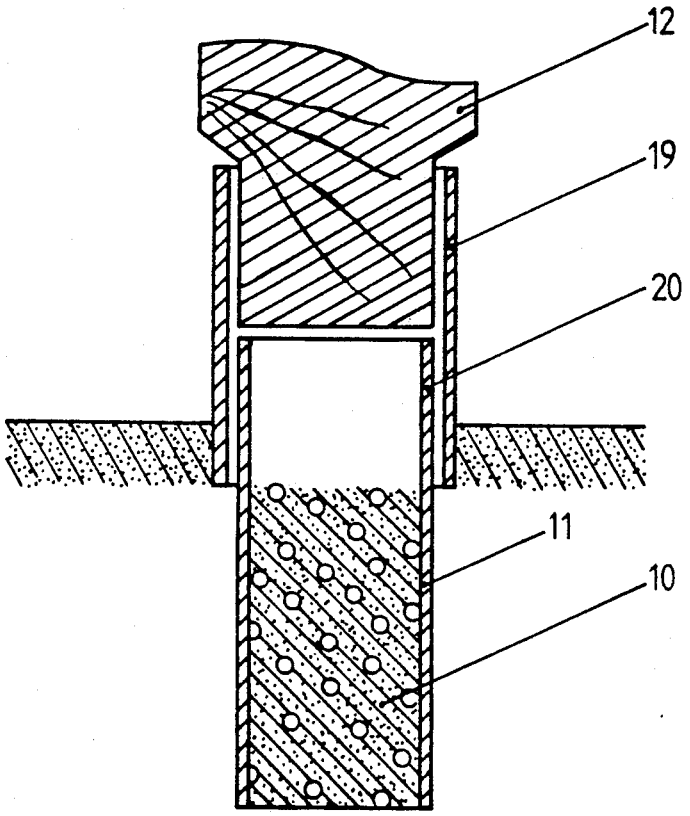
FIG. 6 is a cross-section of a fifth pole replacement section according to the invention.

In FIG. 6 the pole replacement section is used in tandem with a second sleeve 19. Sleeve 11 is filled wholly or partially with concrete 10 and located in the ground with a protrusion 20 above ground level. The pole end 12 is secured atop of the sleeve II and both surrounded by sleeve 19 which is also partially embedded into the ground for added stability.

Figure 7:
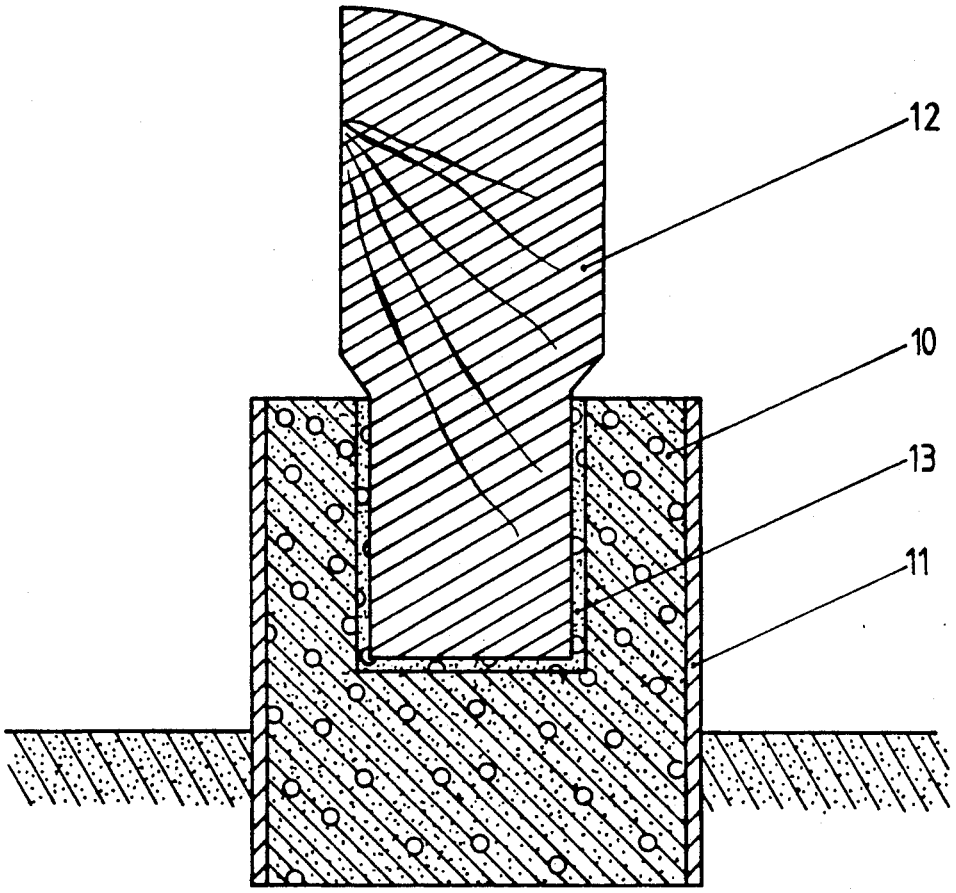
FIG. 7 is a cross-section of a sixth pole replacement section according to the invention.

In FIG. 7 cavity 13 is formed in concrete 10 which otherwise fills sleeve 11 entirely. Thus the pole replacement section presents a larger bearing support surface to the pole adding to stability.

Figure 8:
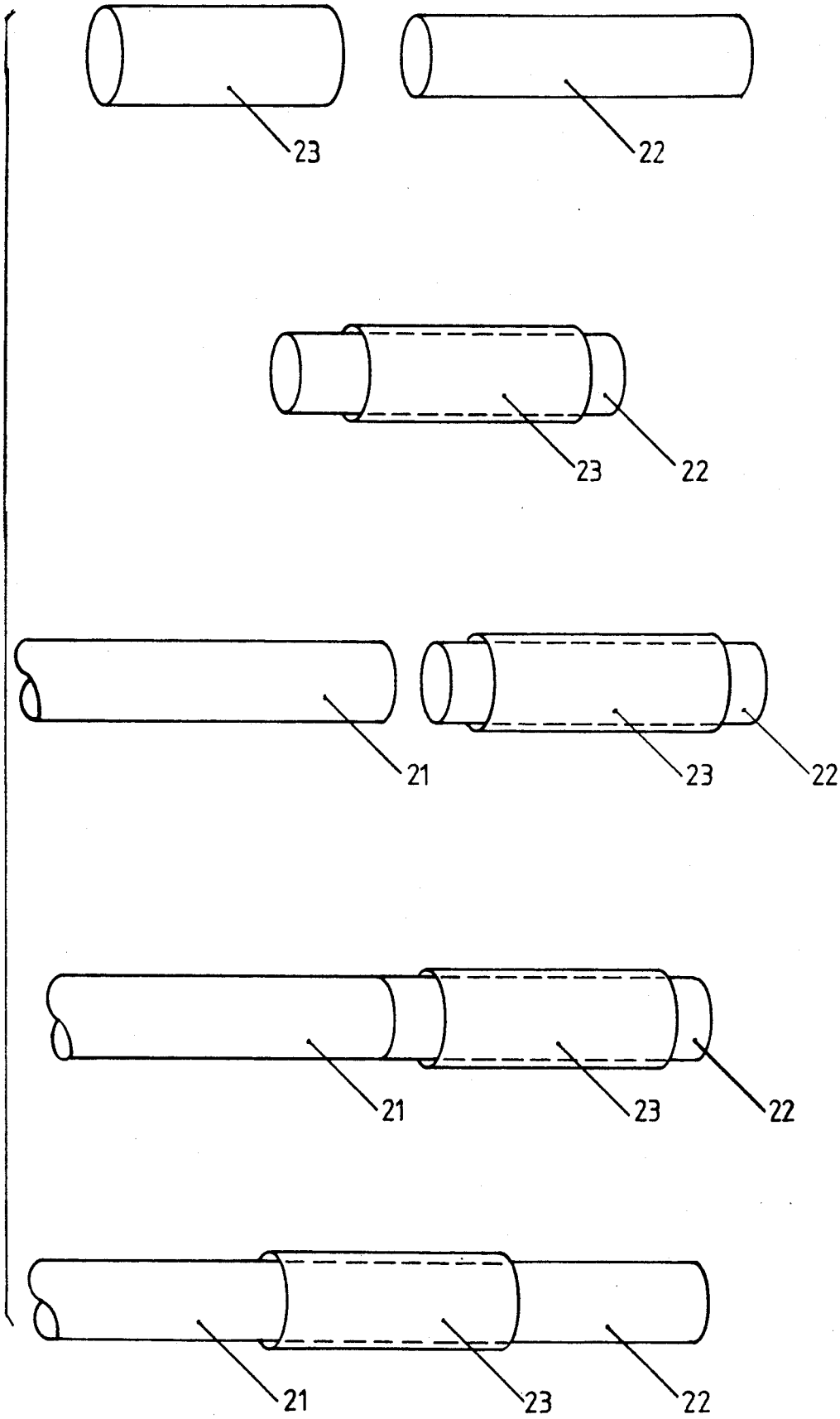
FIG. 8 is a progressive component diagram of an alternate method of the invention.

Referring more particularly to FIG. 8, the invention also provides a method for producing a composite pole, said method in a preferred form comprising or forming a main portion of wood or other material prone to deterioration 21, forming for said main portion 21 a base or stub of concrete or other material 22 resistant to influences causing said deterioration, fabricating a connecting sleeve of steel 23 or other suitable and resistant material, bringing said main portion 21 and stub 22 in coaligned end-to-end registration, placing the sleeve 23 over the conjunction thus formed, and securing the sleeve 23 so that the bass or stub constitutes in effect a substantially rigid continuation of the main portion as a base for the composite pole so formed.

Figure 9:
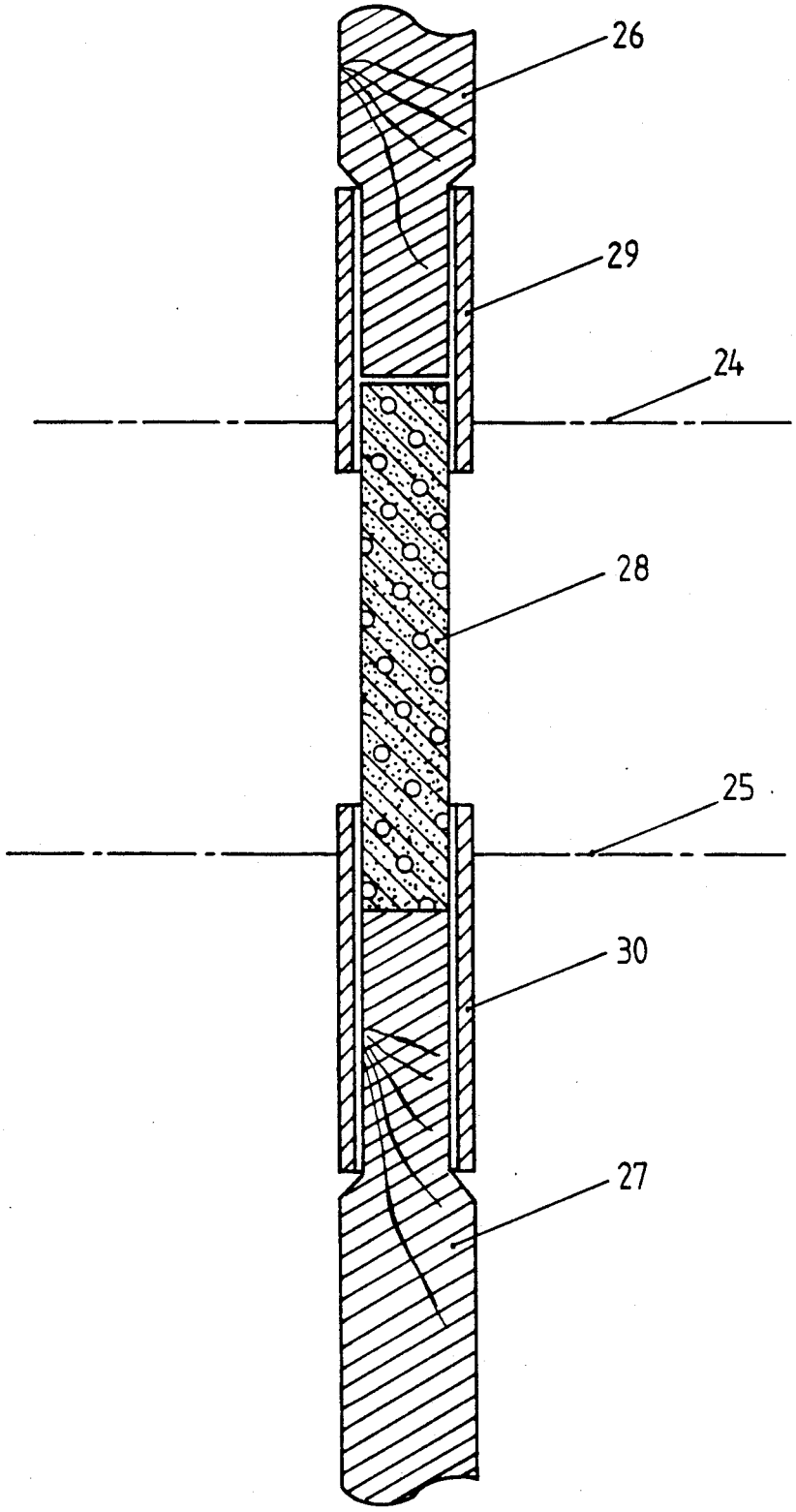
FIG. 9 is a cross-section of a seventh pole replacement section according to the invention.

Referring to FIG. 9, the invention may also be applied towards the restoration or strengthening of pier piles which tend to deteriorate between high and low water levels (24,25 respectively) rather than at the seabed. Such piles are prone to collapse under sustained or transient conditions of high load due e.g. to heavy seas and accidental impact by water-craft. Accordingly a damaged or damage-prone length or section of the pile is wholly or partially removed and between the remaining portions 26,27 is fitted a corrosion-resistant pole insert 28 which may be of wood, concrete or other suitable material, having sliding end-sleeves 29, 30 adapted to be positioned over and secured to end portions of 26 and 27, the lastmentioned having been preshaped, as necessary, to be receivable in the sleeves.

In an alternative embodiment it is possible to eliminate the use of concrete etc. by providing an insert consisting of two or more telescoping sleeves of steel, fibre-reinforced plastics or any other suitable material and adapted, under load, to be rigidified by introduction of sand or other suitable material. Sand has the advantage that the tube(s) can be filled on-site. This can reduce the lead time to 1-2 days. Holes can be drilled through the sleeves to drain out water or to allow for inspection of timber inside the sleeve.

The claims defining the invention are as follow; I claim:

1. A method of providing a replacement base for a pole, including the steps of:

fixing a major portion of a tube or pipe vertically in the ground, introducing into the tube a quantity of hardenable concrete or other substantially incompressible material, said quantity being less than the volume of the tube and totally located within the tube, the material and tube or pipe defining a performed, open cavity to receive an end of a pole, and allowing the material to set or consolidate as necessary, and after the material has set or consolidated sufficiently to support the pole, locating the end of the pole in the cavity.

2. A method of restoring, strengthening, lengthening or shortening a load-bearing or normally load-bearing pole, comprising the steps of:

independently supporting the load, as necessary, to relieve the pole thereof, locating in the ground a major portion of a substantially rigid sleeve partially filled with solid, substantially incompressible material to a predetermined level, which material defines a pole supporting surface at said predetermined level between ends of the sleeve such that the pole supporting surface defines with the sleeve a preformed, open cavity to receive an end of a pole, said material being located in said sleeve and not extending axially beyond said sleeve, and fitting the pole into the open cavity and supporting an end of the pole on the pole supporting surface at the predetermined level such that when the load is again put on the pole the sleeve is rigidified by pressure of the material and the pole therein, the sleeve and material thereby constituting, in effect, a portion of the pole.

3. A method of restoring, strengthening, lengthening or shortening a load-bearing or normal load-bearing pole, comprising the steps of:

(a) independently supporting the load, as necessary, to relieve the pole thereof, (b) locating a major portion of a substantially rigid sleeve in the ground, (c) partially filling the sleeve with hardenable, substantially incompressible material to a predetermined level displaced from an upper end of the sleeve, which material defines a pole supporting surface at said predetermined level, the pole supporting surface defining with the sleeve a preformed, open cavity to receive an end of a pole, the material being located in the sleeve and not extending axially beyond the sleeve, (d) allowing the material to set sufficiently to support the pole, and (e) fitting the pole into the open cavity and supporting an end of the pole on the pole supporting surface at the predetermined level such that when the load is again put on the pole the sleeve is rigidified by pressure of the set material and pole therein, the sleeve and material thereby constituting, in effect, a portion of the pole.

4. A pole replacement section of substantially non-corrosive material, comprising: a sleeve having a first end and a second end and being partially filled with solid, substantially non-compressible material to a predetermined level displaced from the first end, the solid, substantially non-compressible material defining a pole supporting surface at said predetermined level, said pole supporting surface defining with the sleeve a preformed, open cavity adapted to receive an end of a pole and maintain the end of the pole at said predetermined level, said material being located in said sleeve and not extending axially beyond said sleeve.

5. A pole replacement section according to claim 4, wherein the sleeve is provided with wedging means to assist firm location of the end of the pole in the cavity.

6. A pole replacement section of claim 5 wherein the wedging means comprises a plurality of wedges located in the cavity about the periphery of the sleeve.

7. A pole replacement section according to claim 6 wherein said wedges taper in width upwardly such that said cavity has a width which tapers downwardly.

8. A pole replacement section of claim 5 wherein the wedging means comprises a plurality of resilient members located about the periphery of the sleeve in the cavity and resiliently deformable towards the sleeve.

9. A pole replacement section according to claim 8 wherein the resilient members are spring steel bars each having a portion radially displaced from the periphery of the sleeve towards the axis of the sleeve.

10. A pole replacement section according to claim 8 wherein said resilient members extend downwardly and inwardly such that said cavity has a width which tapers downwardly.

11. A pole replacement section according to claim 5 wherein the sleeve is provided with drain apertures in the cavity thereof.

12. A pole replacement section according to claim 1 wherein said non-compressible material is only located in said sleeve.

13. A pole replacement section according to claim 5 wherein said wedging means define a lateral surface of said cavity which tapers inwardly and downwardly.

* * * * *